United States Patent [19]

Weinhold

[11] Patent Number: 4,863,348

[45] Date of Patent: Sep. 5, 1989

[54] BLADE, ESPECIALLY A ROTOR BLADE

[76] Inventor: Wolfgang P. Weinhold, Wiener Ring 17, D-8700 Wuerzburg, Fed. Rep. of Germany

[21] Appl. No.: 206,872

[22] Filed: Jun. 10, 1988

Related U.S. Application Data

[63] Continuation-in-part of Ser. No. 11,788, Feb. 6, 1987, abandoned.

[30] Foreign Application Priority Data

May 5, 1988 [EP] European Pat. Off. ..... 88101712.3

[51] Int. Cl.[4] ..... F04D 29/16; F01D 5/20

[52] U.S. Cl. ..... 416/92; 415/173.1; 415/115

[58] Field of Search ..... 416/92, 97 R, 97 A, 416/90 R; 415/172 A, DIG. 1 R, 111-112, 117, 170 R, 116, 175, 176

[56] References Cited

U.S. PATENT DOCUMENTS

| | | | |
|---|---|---|---|
| 2,888,243 | 5/1959 | Pollock | 416/92 |
| 3,132,839 | 5/1964 | Haekal | 415/DIG. 1 |
| 3,515,499 | 6/1970 | Beer et al. | 416/97 A X |
| 3,527,543 | 9/1970 | Howald | 416/97 A X |
| 4,040,767 | 8/1977 | Dierberger et al. | 416/97 A X |
| 4,197,443 | 4/1980 | Sidenstick | 416/97 A X |
| 4,221,539 | 9/1980 | Corrigan | 416/97 R |
| 4,335,995 | 6/1982 | Riollet et al. | 415/DIG. 1 X |
| 4,390,320 | 6/1983 | Eiswerth | 416/97 R |
| 4,424,001 | 1/1984 | North et al. | 416/92 |
| 4,540,339 | 9/1985 | Horvath | 416/92 |
| 4,571,937 | 2/1986 | Albers | 60/39.75 |
| 4,589,823 | 5/1986 | Koffel | 416/92 |
| 4,601,638 | 7/1986 | Hill et al. | 416/97 R |
| 4,606,701 | 8/1986 | McClay et al. | 416/92 |
| 4,653,983 | 3/1987 | Vehr | 416/97 R |

FOREIGN PATENT DOCUMENTS

| | | | |
|---|---|---|---|
| 599697 | 6/1960 | Canada | 415/172 A |
| 1002324 | 3/1952 | France | 416/92 |
| 65804 | 4/1982 | Japan | 415/DIG. 1 |
| 47104 | 3/1983 | Japan | 416/92 |

*Primary Examiner*—Everette A. Powell, Jr.

*Attorney, Agent, or Firm*—Laurence R. Brown; Alfred J. Mangels

[57] ABSTRACT

A rotor blade particularly adapted for turbine engines includes various injection holes on the blade tip and near the blade tip and on the root plane and near the root plane so directed as to reduce the tip leakage flow crossing the tip and to control the boundary layer by means of fluid curtain and entrainment effects.

17 Claims, 8 Drawing Sheets

BLADE, ESPECIALLY A ROTOR BLADE

Cross-Reference to Related Application

This application is a continuation-in-part of copending application Ser. No. 07/011,788, filed Feb. 6, 1987, now abandoned.

BACKGROUND OF THE INVENTION

1. Field of the Invention

The present invention relates generally to blades used for example in turbomachinery, and particularly to an improved turbine rotor blade.

2. Description of the Related Art

A gap between the rotor and the casing exists in all turbomachinery such as gas turbine engines, compressors, radial compressors or pumps. Furthermore, the minimum size of this gap is dictated by different rates of thermal expansion and radial growth of the blades and the casing during different operational conditions. It is well established that greater operating efficiency and power output of a turbomachine may be achieved by any means reducing the tip leakage flow, controlling the boundary layer, and increasing inlet operation temperatures.

The tip leakage flow is the largest single source of energy loss in a turbomachine. The interaction of leakage flow, blade, and annulus wall boundary layers and radial transport of mass, momentum and energy results in a highly complex flow field near the tip region of a turbomachine.

In order to reduce the tip leakage flow several ideas have been used, such as the cutting of grooves, squellers, or the use of abrasive materials applied either on the blade tip or on the casing, in order to obtain the smallest possible clearance and thereby reduce the leakage flow by increasing the flow resistance in the tip region from the pressure to the suction side. Such structures are described in greater detail in U.S. Pat. Nos. 4,589,823 and 4,571,937.

A further idea to reduce the tip leakage flow is the so called active clearance control. Thereby, the clearance or gap between the tip of the rotor blade and the casing of a turbine engine is maintained at a minimum by cooling or heating the casing of the turbine engine.

Furthermore, other problems exist:

The high temperatures downstream of the combustion chamber in a gas turbine require cooled rotor blades due to material constraints. The structures providing cooling for the turbine blades have generally a cooling fluid entrance at the root of the blade structure and exhaust exits located at the trailing edge, leading edge and at the tip plane of the blade. These exhaust exits are used to get rid of the cooling fluid or to produce a film of cooling air as in U.S. Pat. Nos. 4,601,638. Hill, Liang, and Auxier in U.S. Pat. No. 4,601,638 teach the use of air holes to provide cooling, the air holes having axes which run parallel to the plane of the blade tip. Further structures are described in greater detail in U.S. Pat. Nos. 4,424,001, 4, 540,339 and 4,606,701.

According to U.S. Pat. No. 4,540,339, for example, a cooling fluid flows through openings arranged in the tip surface of the blade and is directed against the tip side wall surfaces in a plane perpendicular to the side walls.

In U.S. Pat. No. 4,040,767 a coolable nozzle guide vane in the turbine section of a gas turbine engine is disclosed. Cooling air flows out of orifices in the blade side walls and the blade root and is distributed about the walls of the sections which are in contact with the hot working gases flowing through the turbine during operation of the engine.

All these purposes provide cooling of the rotor blade and other sections. However, they do not influence or reduce the tip leakage flow and the corner separation zones.

An object of the invention is an improved configuration for a blade, especially a rotor blade in a turbine engine, by which the energy loss in the turbine engine is significantly reduced.

A further object of the invention is to reduce the tip leakage flow and to influence the complex flow field, thereby to reduce the corner separation zones and the energy losses produced by the complex flow field along the rotor blade.

Yet another object of the present invention is to cool the surfaces of the rotor blade, and its root.

SUMMARY OF THE INVENTION

In accordance with the invention the blade comprises elongated injection holes on the blade tip surface, the axes of said holes forming angles less than 90 degrees with the radial axis of the blade and having a component in the direction of the local chordline of the tip surface. In turbine engines the chordline is approximately parallel to the main flow direction of the working gas along the rotor blade. The injection holes are generally arranged in the tip surface over the whole length thereof between the leading and the trailing edge of the blade. The main flow is thereby diverted in such a manner that no tip leakage flow occurs.

Similar injection holes may be provided in the sidewalls of the blade near the tip and the root regions and in the root portion of the blade. The fluid passing through these holes supports the reduction of the tip leakage flow and/or smooths the flow of the working fluid and makes it more uniform.

It has been found that tip leakage flow and the boundary layer on a blade, as well as the corner separation zones, may be controlled by this specific injection or suction arrangement located at the tip plane and at airfoil sections close to the tip and root plane, respectively, and at the root plane close to the airfoil section. The nature of this tip leakage and boundary control structure is based on an air-curtain effect interwoven with an entrainment effect which reduces the tip leakage flow as well, or controls the boundary layer in such a fashion that the efficiency of the stage increases and the flow field behind the blade is more uniform. Such arrangements may also provide cooling in addition to decreasing tip leakage flow and boundary layer control.

In turbine engines the fluid is blasted out of the injection holes. Nevertheless, in some arrangements, for example in pumps or compressors a fluid, namely the working fluid, may be sucked into the injection holes.

The foregoing and other objections, features and advantages of the present invention will become more apparent in the light of the following detailed description of prefered embodiments thereof as shown in the accompanying drawings.

DESCRIPTION OF THE PREFERRED EMBODIMENTS

Figure 1:
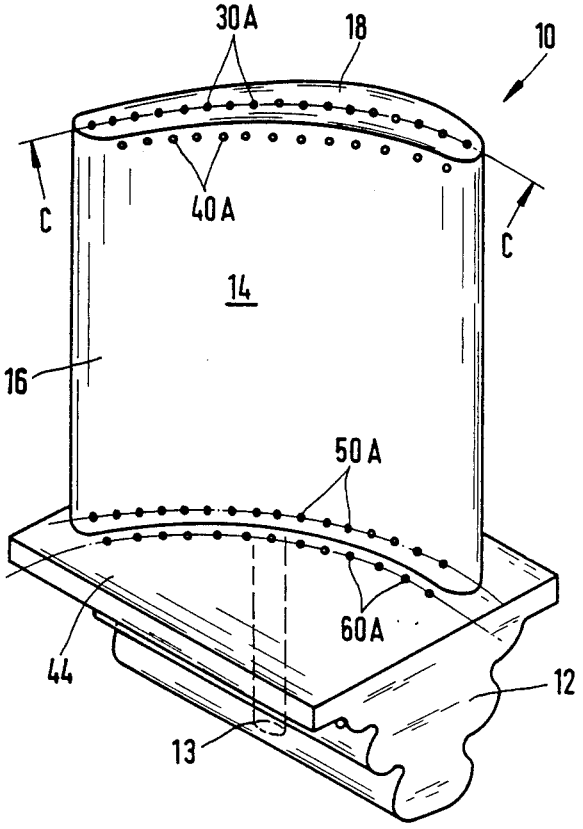
FIG. 1 is a perspective view of a rotor blade according to the invention taken from the concave side thereof.
Figure 2:
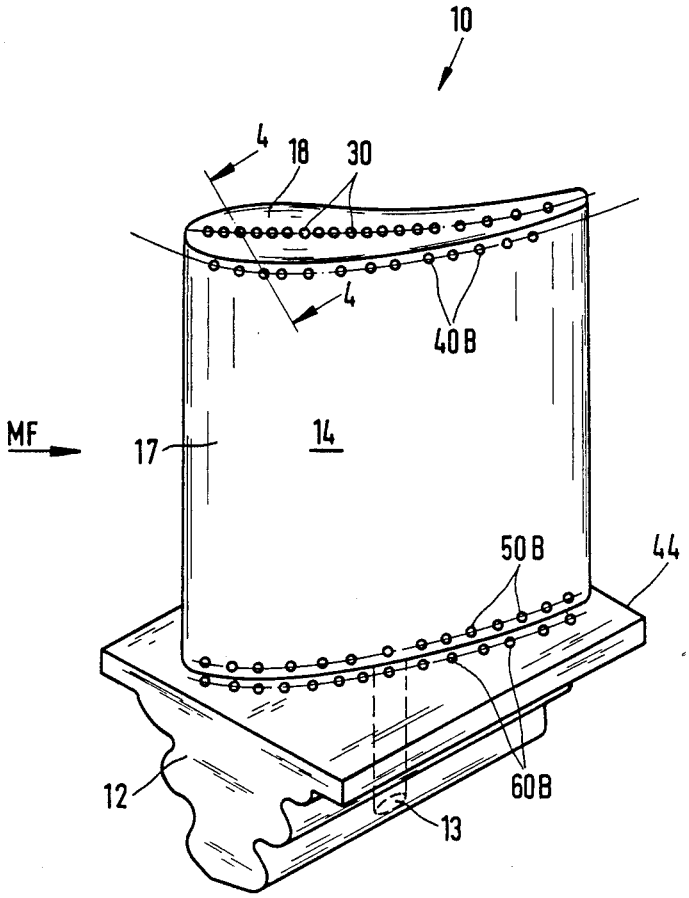
FIG. 2 is a perspective view of the rotor blade taken from the convex side thereof.

FIG. 1 and 2 depict a blade 10 comprising a root portion 12 and a hollow airfoil portion 14. The airfoil portion 14 of the blade 10 is contoured to define a concave side 16, a convex side 17, and has a blade tip 18. The root portion 12 of the blade 10 secures the blade in a rotor disc (not shown) attached rigidly thereto and includes an inlet port 13 leading to various elongate injection holes 30, 40A, 40B, 50A, 50B, 60A and 60B. The main flow direction of a working fluid is designated as MF.

Figure 3:
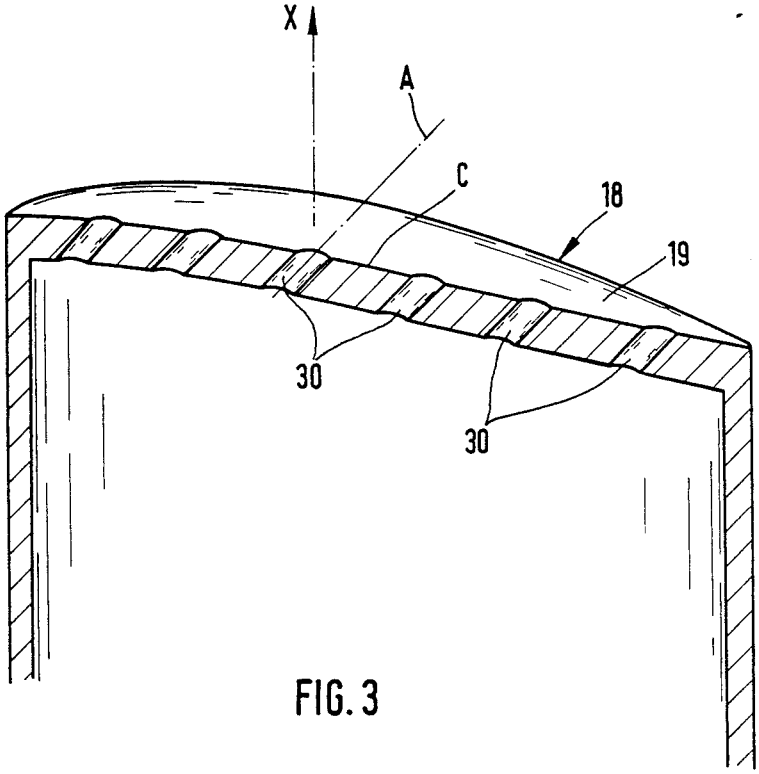
FIG. 3 is a vertical cross section of the rotor blade from the leading to the trailing edge of the tip plane therof.
Figure 4A:
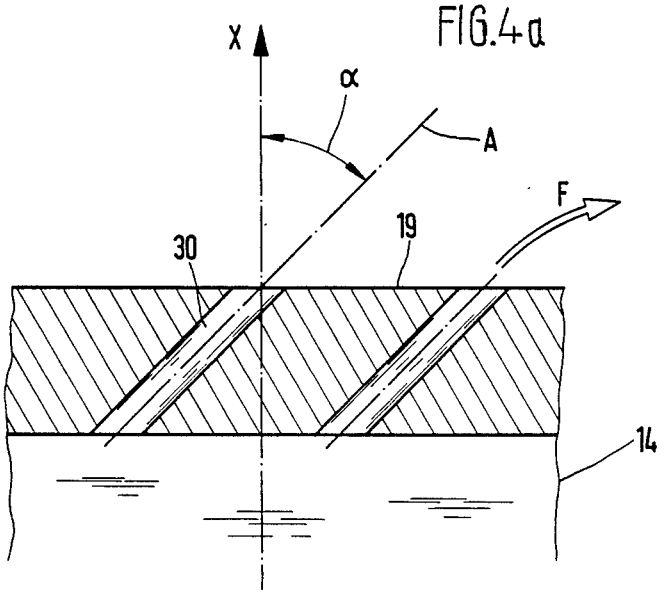
FIG. 4*a* is a detail of FIG. 3 showing injection holes in the tip surface and FIG. 4*b* is a diagram for the direction of the axes of the injection holes.

In accordance with the principles of the invention, the blade 10 has a generally flat surface 19 at the blade tip 18 structured to prevent tip leakage flow driven from the pressure 16 to the suction side 17 of blade 10, crossing the blade tip 18. As is known, a radially extending collar may be provided along the border lines of the tip surface 19 to increase the flow resistance between the pressure and suction sides. The blade tip 18 of the rotor blade 10 comprises a plurality of elongate injection holes 30, arranged in a pattern, for example as shown in a row along a chordline C of the tip surface 19, running from the leading to the trailing edge of the blade. The injection holes 30 should be arranged over the whole peripheral length of the rotor blade 10. The fluid support for the injection running through hollow airfoil portion 14 enters at inlet port 13. The axes A of the elongated injection holes 30 are inclined with respect to the radial axis X of the blade under angles alpha less than 90 degrees. In this embodiment the angle is 45 degrees. Preferred values of this angle are between 15 and 75 degrees. The detail of the injection holes 30 is shown in FIGS. 3 and 4*a*.

Figure 4B:
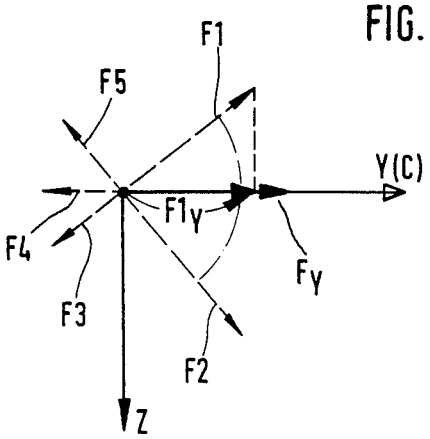

The local direction of the chordline is designated as Y in the diagram of FIG. 4*b*, the direction perpendicular thereto and perpendicular to the radial axis X as Z. The axis A of an injection hole preferably lies in the plane X-Y, so that the fluid F flows upwards with a component $F_Y$ in the local direction of the chordline leading to the trailing edge of the rotor blade.

However, deviations from that flow direction are allowed as shown by the broken lines F1 to F5 showing the components of fluid flows in the Z-Y-plane. These flow directions each have a component in the Y-direction either directed to the trailing edge (F1 and F2) or to the leading edge (F3, F4 and F5) of the rotor blade. Only the component $F1_Y$ is shown. The angle between the Y-direction and the direction of the flow in the Z-Y-plane is less than 90 degrees, preferably less than 60 degrees. For a turbine engine the best results are achieved when the fluid flow F lies in the local X-Y-plane and is directed towards the trailing edge with the component $F_Y$. A direction of the axes towards the leading edge of the blade may be advantageous in case that fluid is sucked into the injection holes, for example in pumps.

The injection holes 30 thus provide means for controlling the boundary layer of blade 10 at the blade tip 18 and thus means for depressing the tip leakage flow crossing the blade tip 18, and the vortices close to blade tip 18.

Figure 5:
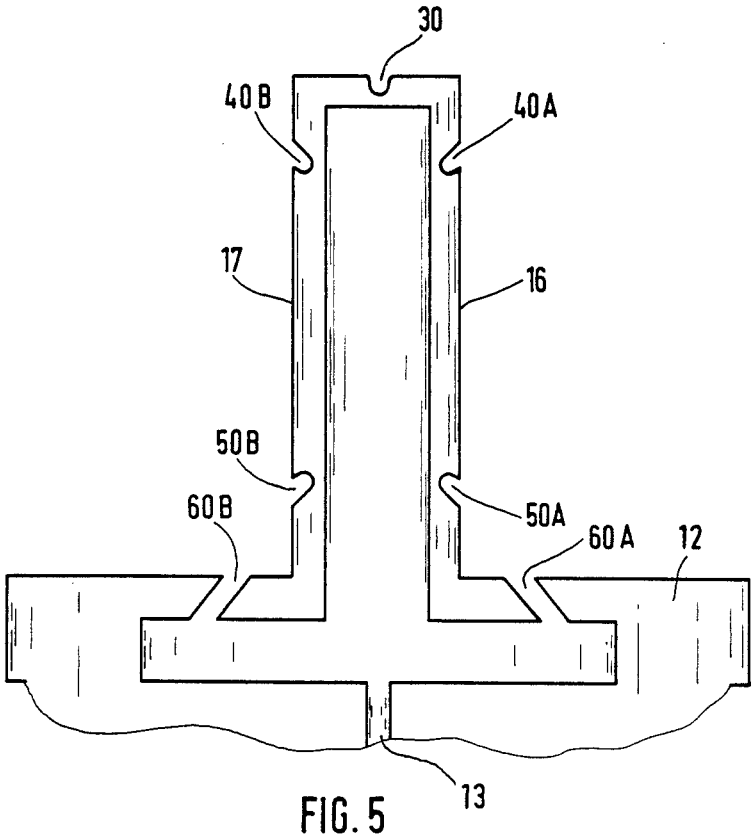
FIG. 5 is a vertical cross section of the rotor blade from the tip to the root thereof.
Figure 6:
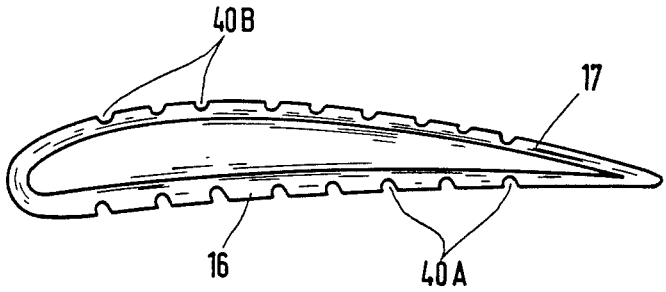
FIG. 6 is a horizontal cross section of the rotor blade adjacent to the tip thereof.

The blade 10 further comprises a plurality of injection holes 40A on the concave side 16 close to blade tip 18, and a plurality of injection holes 40B close to blade tip 18 on the convex side 17. The axes of the injection holes 40A on the pressure side and the holes 40B on the suction side form an angle less than 90 degrees between the radial extended tip plane and the perpendicular on the outer wall respectively. They have a component in the direction of the local main flow MF. In an injection process, such as in a turbine engine, the fluid passing through the injection holes 40A and 40B is directed upwards towards the trailing edge of the blade. In a suction process, such as in a pump, the holes 40A, 40B may be directed towards the leading edge of the blade so that the working fluid may enter into the hollow plenum of the airfoil portion 14. The fluid for the injection coming from hollow airfoil portion 14 enters at inlet port 13. The detail of the injection holes 40A and 40B, and 50A and 50B, and 60A and 60B is shown in FIG. 5. In this figure as well as in FIGS. 6 and 7, holes 40A, 40B, 50A and 50B do not appear to extend to the hollow portion of the blade 18 because of the angle which they make with the plane of the drawings. These holes do, however, communicate with the hollow plenum. The injection holes 40A and 40B thus provide means for controlling the boundary layer and vortices close to the tip on the concave side 16 and the convex side 17, respectively. Moreover, the effect of reducing the tip leakage flow is supported. As shown, the axes of these holes form angles of less than 90 degrees with both the normal to the local plane of the rotor and with the radial axis of the rotor. The axes of those holes are not normal to the local plane of rotor.

Figure 7:
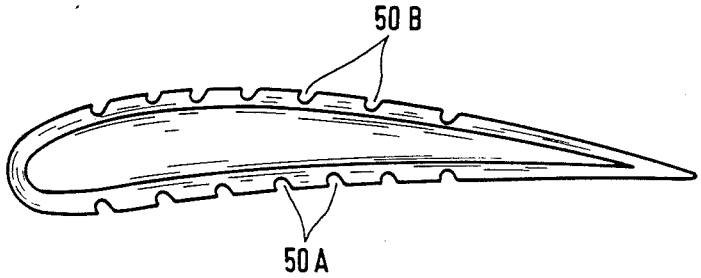
FIG. 7 is a horizontal cross section of the rotor blade adjacent to the root thereof.
Figure 8:
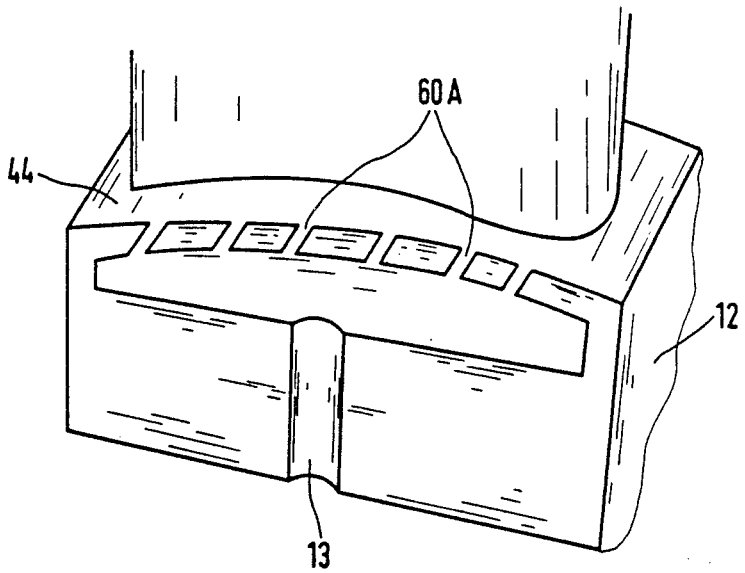
FIG. 8 is a vertical section through the root of the rotor blade.

As shown in FIGS. 5 and 7 blade 10 includes a plurality of injection holes 50A and 50B close to the root plane 44 on the concave side 16 and the convex side 17, respectively. As shown, the axes of the injection holes 50A and 50B are directed towards the blade root 44 and form angles less than 90 degrees with the local plane of the concave side 16 and the convex side 17, respectively. These axes are, however, not normal to the local surface plane. The axes of the elongate holes also form an angle of less than 90 degrees with the radial axis of the rotor. The fluid for the injection comes from the hollow airfoil portion 14 and enters the hollow plenum at said inlet port 13. The horizontal detail of the injection holes 50A and 50B is shown in FIG. 7. The injection holes 50A and 50B thus provide means for controlling the boundary layer and vortices close to the root plane on the concave side 16 and the convex side 17, respectively.

Blade 10 also comprises a plurality of elongate injection holes 60A and 60B close to the concave side 16 and the convex side 17 on the root plane 44. The elongate injection holes 60A and 60B are directed towards the side walls 16, 17 of the blade under angles less than 90 degree with the local perpendicular of the root plane 44. The fluid for the injection enters at inlet port 13. The detail of the injection holes 60A and 60B is shown in FIG. 5. The injection holes 60A and 60B thus provide means for controlling the boundary layer and vortices close to the root plane 44 on the concave side 16 and the convex side 17, respectively.

Figure 9A:
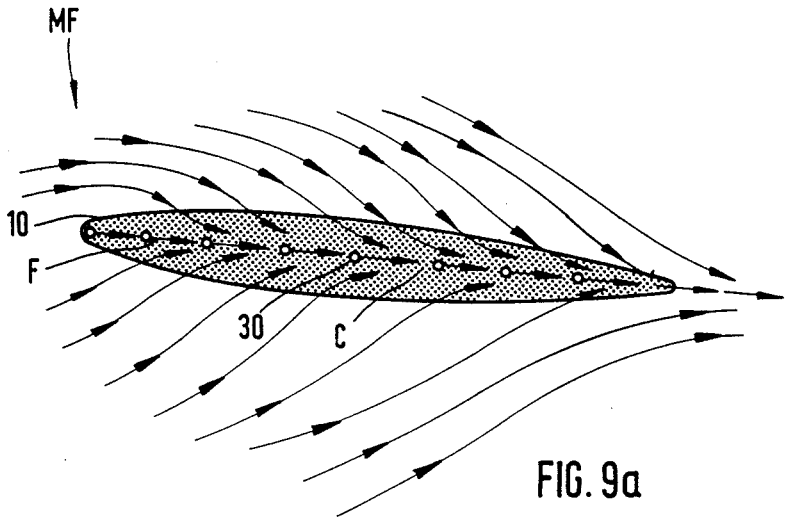
FIGS. 9*a* and 9*b* show the qualitative behavior of the flow near the tip clearance of a standard rotor blade with injection of a fluid into the main stream flow according to the invention and without injection, respectively.
Figure 9B:
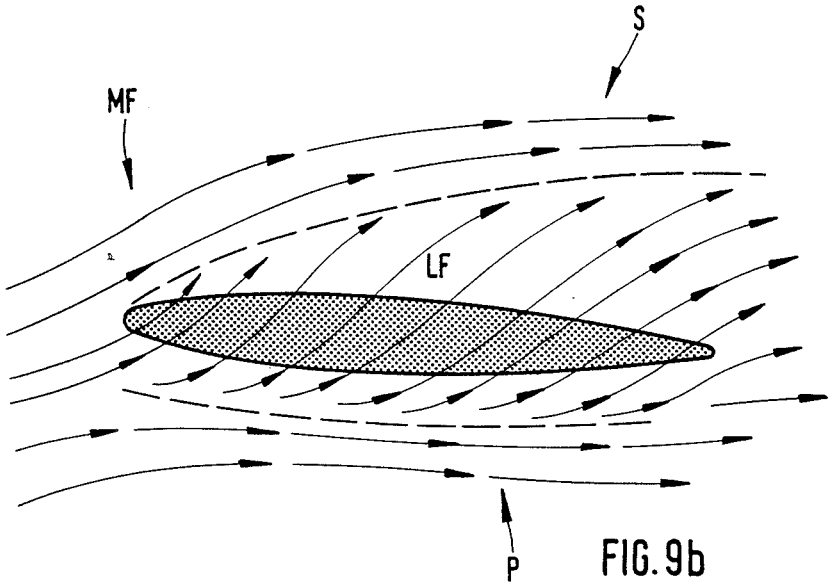

FIG. 9*a* shows the qualitative behavior of the main flow MF along a test standard blade 10 in the tip region.

Through injection holes as shown in FIG. 4 a fluid -short arrows F- is injected in the main flow between the pressure and suction side and directed upwards towards the trailing edge of the blade, with a component in the chordline C.

The mainflow MF is diverted in the direction of the fluid flow F. No tip leakage flow occurs. Furthermore, the main flow is smoothed so that the secondary effects in the flow field, such as vortices and distortions in the boundary layer region, are significantly reduced. The volume of fluid injection through the holes into the gap region has a value between 0,05% and 0,4% of the working fluid volume, dependent on the configuration of the blade and the casing. Best results for a blade as shown in FIGS. 1 and 2 may be achieved for values between 0,15% and 0,25%.

On the other hand, a conventional standard rotor blade having no injection holes arranged and directed as in FIG. 9*a* produces a significant leakage flow LF between the pressure side P and the suction side S of the main flow MF interwoven with secondary effects. It is to be pointed out that the occurrence of leakage flow LF cannot be suppressed even if a fluid is blown into the gap region radially or in a plane perpendicular to the local chordline as known in the state of the art for cooling purpose.

The invention may be used for example to reduce the leakage flow between a stator with adjustable guide vanes and a rotating shaft and to improve the secondary effects of the main flow as explained above.

I claim:

1. A blade having a leading edge and a trailing edge, especially a rotor blade, said blade comprising: a root portion; an airfoil portion extending from the root portion and terminating in a blade tip surface, the airfoil portion having an axis and a pair of walls contoured to define respective concave and convex outer sides for intercepting a main flow of fluid; a hollow plenum defined between the walls of the airfoil portion and communicating with the root portion for permitting the flow of injection fluid between the root portion and the plenum; and a plurality of injection holes at the blade tip and communicating with the plenum to permit fluid flow between the plenum and the injection holes, the axes of said injection holes forming angles less than 90 degrees with the axis of the airfoil portion to provide an injection fluid flow component in the direction of a local chordline of the tip surface from the leading edge toward the trailing edge of the airfoil portion, thereby reducing the tip leakage flow and controlling the boundary layer on the concave and convex airfoil surfaces in the vicinity of the tip region.

2. A blade according to claim 1, wherein the injection holes are distributed at the blade tip surface over the entire length of a chordline extending from the leading to the trailing edge of the blade tip surface.

3. A blade according to claim 1, wherein the injection holes are arranged in a generally flat surface of the blade tip.

4. A blade according to claim 1, wherein the angle between the axis of each injection hole and the axis of the airfoil is between 15 and 75 degrees.

5. A blade according to claim 1, wherein the axis of each injection hole projected onto the blade tip surface forms an angle less than 60 degrees with a local chordline at the blade tip surface.

6. A blade according to claim 5, wherein the projected axis is coincident with a local chordline and is directed toward the trailing edge of the blade.

7. A blade according to claim 1, including a plurality of second injection holes in said concave and convex sides adjacent said blade tip surface, the axis of each second hole forming an angle less than 90 degrees with a line normal to the outer wall and also forming an angle less than 90 degrees with the airfoil axis.

8. A blade according to claim 7, wherein the axis of each second injection hole is directed upwards towards the blade tip surface and towards the trailing edge of the blade.

9. A blade according to claim 1, including a plurality of third injection holes in said concave and convex sides and adjacent the root portion of the blade, the axes of the third injection holes being directed towards the root portion of the blade.

10. A blade according to claim 9, wherein the axis of each third injection hole forms an angle less than 90 degrees with a line normal to the respective outer side of the blade and also an angle less than 90 degrees with the airfoil axis of the blade.

11. A blade according to claim 9, wherein the axis of each third injection hole has a component in the direction towards the trailing edge of the blade.

12. A blade according to claim 1, including a plurality of fourth injection holes in the root portion adjacent the concave and convex sides of the airfoil, the axis of each fourth injection hole being directed towards an airfoil surface.

13. A blade according to claim 12, wherein the axis of each fourth injection hole forms an angle less than 90 degrees with a transverse plane of the root portion that is perpendicular to the airfoil axis.

14. A blade according to claim 13, wherein the axes of the fourth injection holes each have a component directed towards the trailing edge of the blade.

15. A blade according to claim 1, wherein the injection holes have an aggregate flow area to provide an injection fluid flow volume rate passing through the injection holes in the blade tip surface of from about 0.05% to about 0.4% of the main fluid flow volume rate passing across the blade.

16. A blade according to claim 15, wherein the aggregate injection hole flow area provides an injection fluid flow volume rate passing through the injection holes of from about 0.15% to about 0.25% of the main fluid flow volume rate passing across the blade.

17. A blade according to claim 1, wherein the angle between the axis of each injection hole and the axis of the airfoil is substantially 45 degrees.

* * * * *